US009038226B1

(12) United States Patent
Franklin

(10) Patent No.: US 9,038,226 B1
(45) Date of Patent: May 26, 2015

(54) TOOTHBRUSH HAVING LIGHT EMITTERS ON A BOTTOM SIDE

(71) Applicant: Patrick Franklin, Butte, MT (US)

(72) Inventor: Patrick Franklin, Butte, MT (US)

( * ) Notice: Subject to any disclaimer, the term of this patent is extended or adjusted under 35 U.S.C. 154(b) by 0 days.

(21) Appl. No.: 14/247,527

(22) Filed: Apr. 8, 2014

(51) Int. Cl.
*A46B 15/00* (2006.01)
*A46B 9/04* (2006.01)

(52) U.S. Cl.
CPC ..... *A46B 15/0044* (2013.01); *A46B 9/04* (2013.01); *A46B 15/0008* (2013.01)

(58) Field of Classification Search
CPC ..... A46B 9/04; A46B 15/0008
USPC ..... 15/22.1, 28, 106, 167.1
See application file for complete search history.

(56) References Cited

U.S. PATENT DOCUMENTS

| | | | | | |
|---|---|---|---|---|---|
| 3,156,804 | A * | 11/1964 | Springer et al. | ..... | 200/548 |
| 3,771,186 | A * | 11/1973 | Moret et al. | ..... | 15/22.1 |
| 5,887,601 | A * | 3/1999 | King | ..... | 132/311 |
| 5,894,453 | A * | 4/1999 | Pond | ..... | 368/10 |
| 5,894,620 | A * | 4/1999 | Polaert et al. | ..... | 15/22.1 |
| 5,921,251 | A * | 7/1999 | Joshi | ..... | 132/112 |
| D414,341 | S | 9/1999 | Crisio, Jr. | | |
| 6,106,294 | A * | 8/2000 | Daniel | ..... | 433/216 |
| 6,606,755 | B1 | 8/2003 | Robinson et al. | | |
| 6,954,961 | B2 * | 10/2005 | Ferber et al. | ..... | 15/22.1 |
| 7,571,508 | B1 * | 8/2009 | Yufa | ..... | 15/22.1 |
| 8,079,109 | B2 * | 12/2011 | Misner et al. | ..... | 15/105 |
| 8,272,091 | B2 | 9/2012 | Hwang et al. | | |
| 8,327,491 | B2 * | 12/2012 | Nanda | ..... | 15/105 |
| 8,429,783 | B2 * | 4/2013 | Russell et al. | ..... | 15/105 |
| 8,499,402 | B1 * | 8/2013 | Arsenault | ..... | 15/167.1 |
| 8,533,892 | B2 * | 9/2013 | Dabrowski | ..... | 15/167.1 |
| 8,561,249 | B1 * | 10/2013 | Malakova et al. | ..... | 15/167.1 |
| 8,585,411 | B2 * | 11/2013 | Puurunen et al. | ..... | 434/263 |
| 8,595,882 | B2 * | 12/2013 | Bax et al. | ..... | 15/22.1 |
| 2002/0017474 | A1 * | 2/2002 | Blaustein et al. | ..... | 206/362.2 |
| 2004/0053190 | A1 * | 3/2004 | Lin | ..... | 433/29 |
| 2005/0053896 | A1 | 3/2005 | Pinyayev et al. | | |
| 2008/0250591 | A1 * | 10/2008 | Nanda | ..... | 15/167.1 |
| 2010/0024143 | A1 | 2/2010 | Dickie | | |
| 2010/0043161 | A1 * | 2/2010 | Tanuma | ..... | 15/106 |
| 2010/0330538 | A1 * | 12/2010 | Salazar et al. | ..... | 433/216 |
| 2011/0067189 | A1 | 3/2011 | Major | | |
| 2012/0011666 | A1 * | 1/2012 | Fritsch | ..... | 15/22.1 |
| 2012/0272464 | A1 * | 11/2012 | Bax et al. | ..... | 15/22.1 |
| 2013/0061412 | A1 * | 3/2013 | Vashi | ..... | 15/106 |

* cited by examiner

*Primary Examiner* — Monica Carter
*Assistant Examiner* — Michael Jennings
(74) *Attorney, Agent, or Firm* — Kyle A. Fletcher, Esq.

(57) ABSTRACT

The toothbrush having light emitters on a bottom side includes a handle that may be gripped by a user. The handle is positionable proximate the user's mouth. A bristle is coupled to the handle. The bristle engages the user's teeth when the handle is positioned proximate the user's mouth. A processor is coupled to the handle. A light emitter is coupled to the handle. The light emitter is operationally coupled to the processor. The light emitter selectively emits light. The light emitter may communicate the maximum duration of time. An actuator is coupled to the handle. The actuator is operationally coupled top the processor. The actuator selectively actuates the processor.

13 Claims, 5 Drawing Sheets

TOOTHBRUSH HAVING LIGHT EMITTERS ON A BOTTOM SIDE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of toothbrushes, more specifically, toothbrushes having light emitters for communicating to an end user that a maximum amount of time for brushing has been completed.

SUMMARY OF THE INVENTION

An embodiment of the disclosure meets the needs presented above by generally comprising a handle that may be gripped by a user. The handle is positionable proximate the user's mouth. A bristle is coupled to the handle. The bristle engages the user's teeth when the handle is positioned proximate the user's mouth. A processor is coupled to the handle. A light emitter is coupled to the handle. The light emitter is operationally coupled to the processor. The light emitter selectively emits light. The light emitter may communicate the maximum duration operationally coupled top the processor. The actuator selectively actuates the processor.

An object of the invention is to provide a device that is toothbrush having a light emitter on a surface of the handle opposite of the bristles.

These together with additional objects, features and advantages of the toothbrush having light emitters on a bottom side will be readily apparent to those of ordinary skill in the art upon reading the following detailed description of presently preferred, but nonetheless illustrative, embodiments of the toothbrush having light emitters on a bottom side when taken in conjunction with the accompanying drawings.

In this respect, before explaining the current embodiments of the toothbrush having light emitters on a bottom side in detail, it is to be understood that the toothbrush having light emitters on a bottom side is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toothbrush having light emitters on a bottom side.

It is therefore important that the claims be regarded as including such equivalent construction insofar as they do not depart from the spirit and scope of the toothbrush having light emitters on a bottom side. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
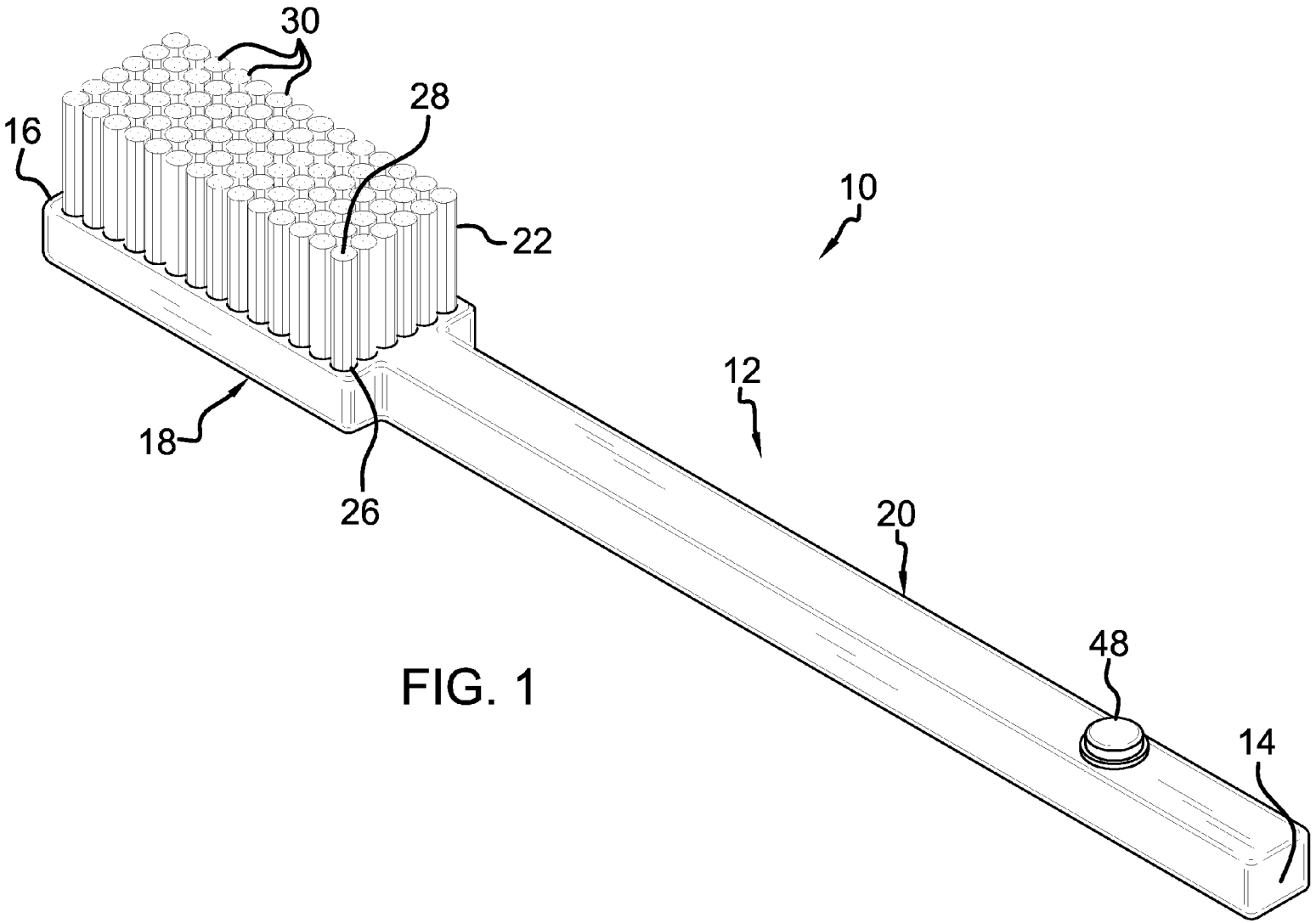
FIG. 1 is a perspective view of the toothbrush according to an embodiment of the disclosure.
Figure 2:
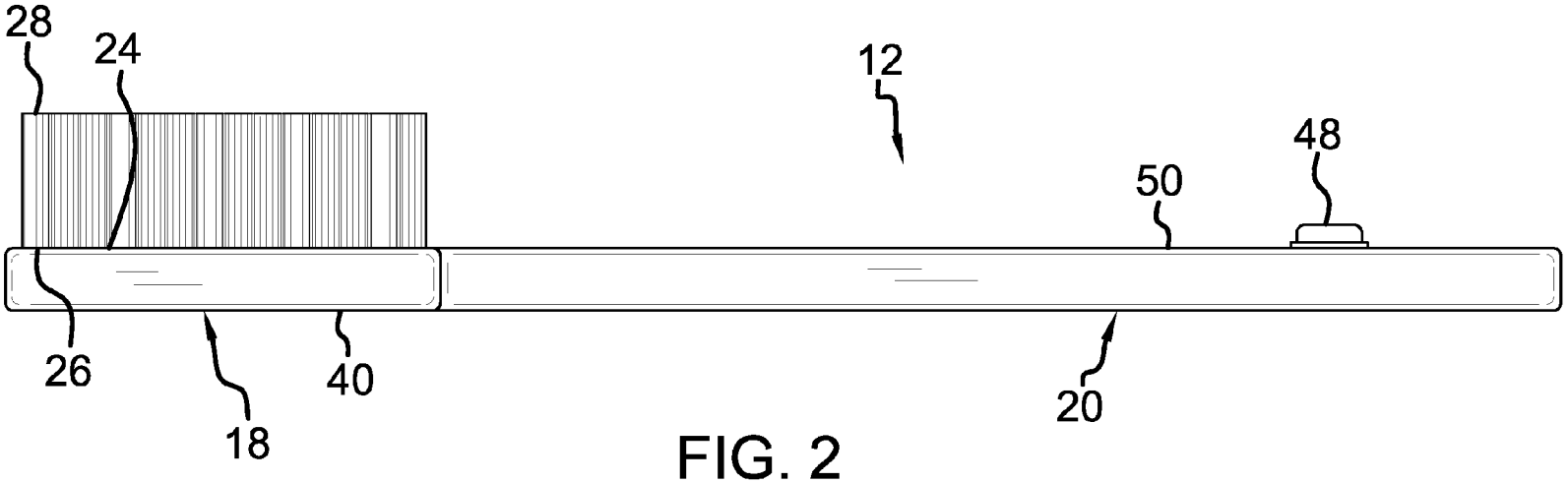
FIG. 2 is a left side view of an embodiment of the disclosure.
Figure 3:
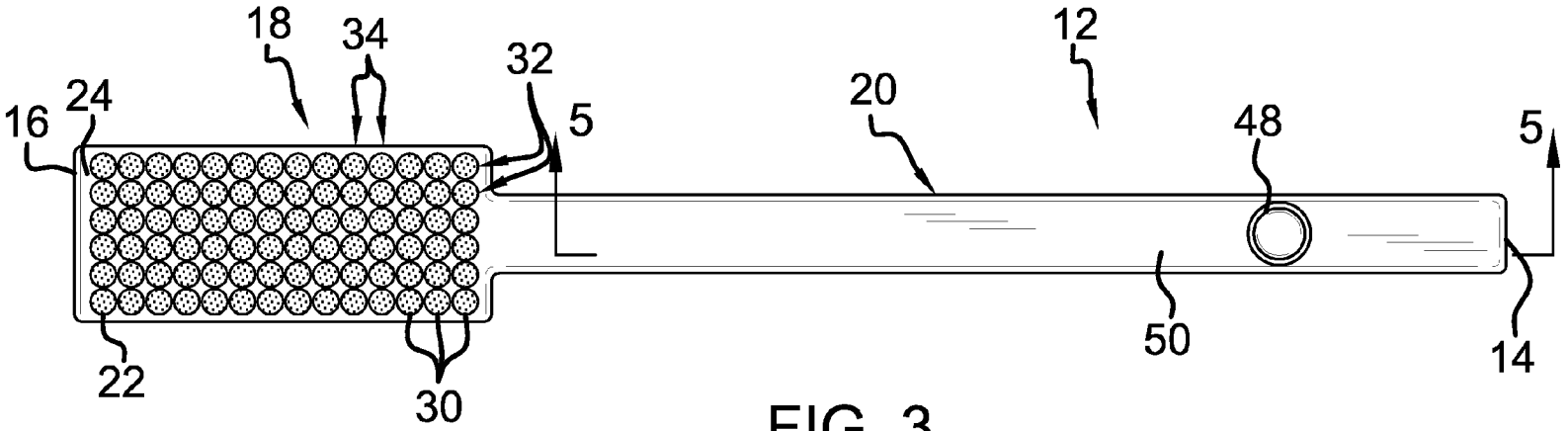
FIG. 3 is a top view of an embodiment of the disclosure.
Figure 4:
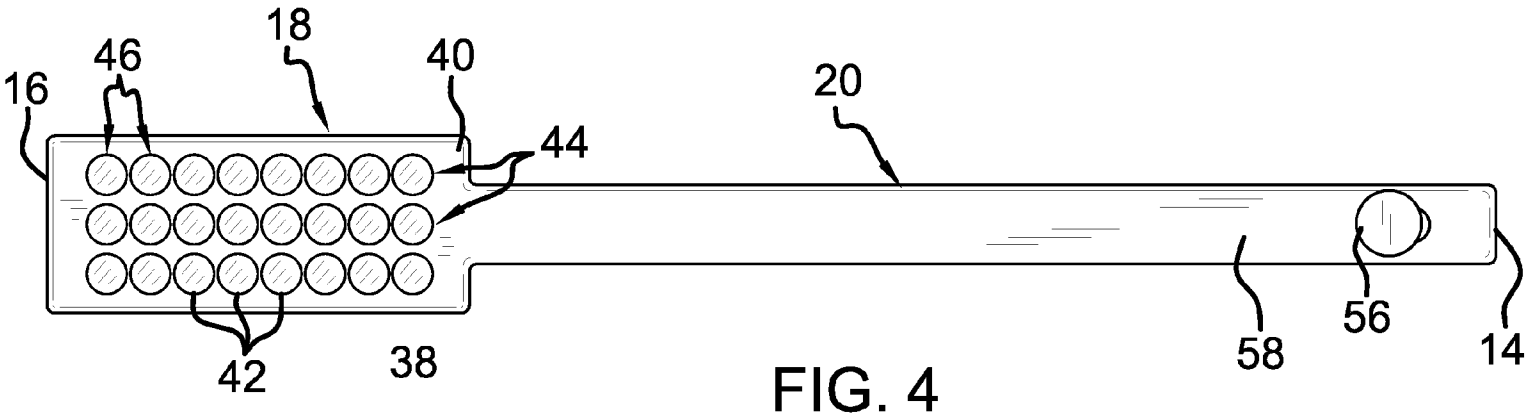
FIG. 4 is a bottom view of an embodiment of the disclosure.
Figure 5:
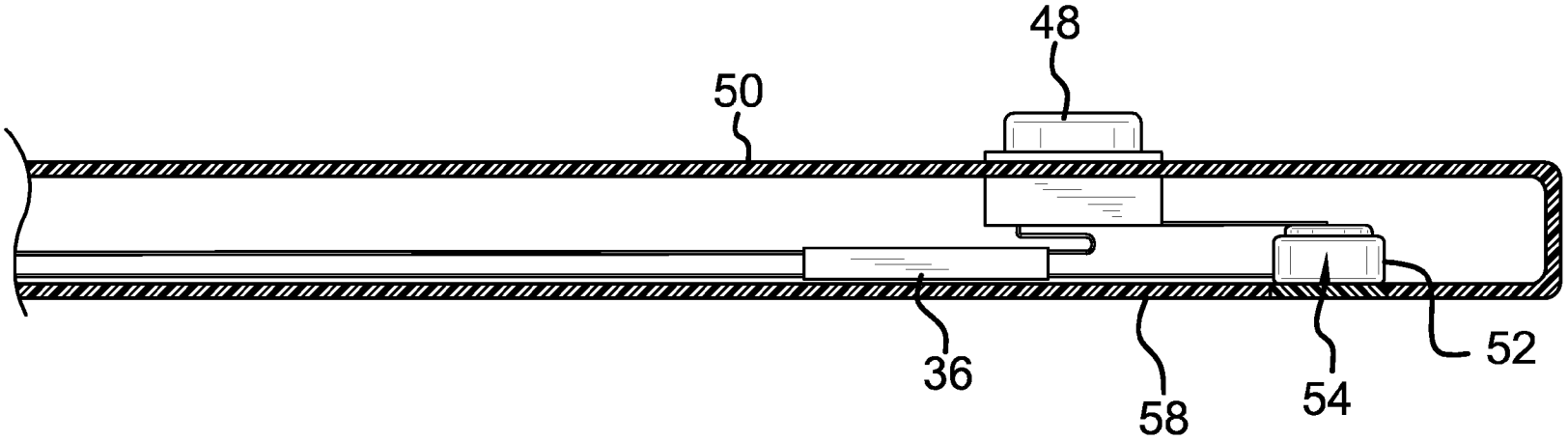
FIG. 5 is a cross sectional view taken along line 5-5 of FIG. 3 of an embodiment of the disclosure.
Figure 6:
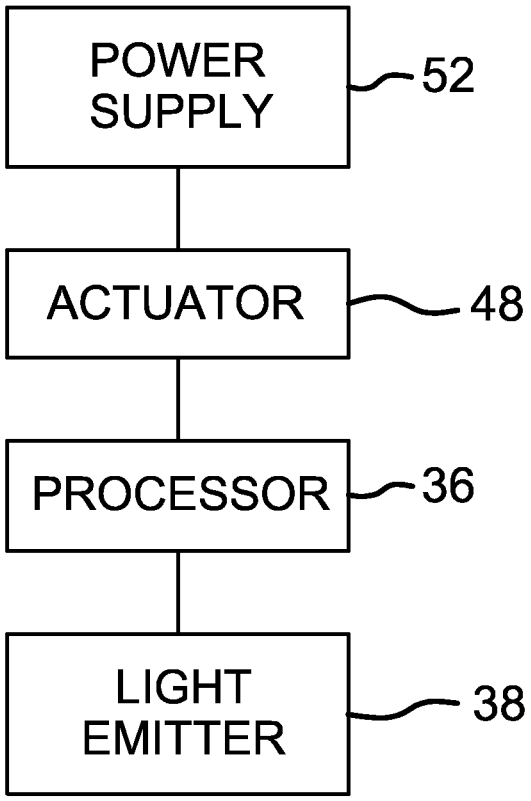
FIG. 6 is a schematic view an embodiment of the disclosure.

As best illustrated in FIGS. 1 through 6, the assembly 10 generally comprises a handle 12. The handle 12 is elongated along a longitudinal axis extending through a first end 14 and a second end 16 of the handle 12. Additionally, the handle 12 has a width is greater than a height of the handle 12. The handle 12 has a rectangular parallelepiped shape that may have a length between 15 cm and 20 cm. Finally, the handle 12 may be gripped by a user so the handle 12 is positionable proximate the user's mouth.

A bristle portion 18 of the handle 12 has a width that is greater than a gripping portion 20 of the handle 12. The bristle portion 18 of the handle 12 may have a width between 12 mm and 20 mm. Additionally, the bristle portion 18 of the handle 12 has a length that is less than a length of the gripping portion 20 of the handle 12. The bristle portion 18 of the handle 12 may have a length between 30 mm and 40 mm.

A bristle 22 is coupled to and extends away from a top side 24 of the bristle portion 18 of the handle 12. The bristle 22 is elongated along a line extending through a coupled end 26 and a free end 28 of the bristle 22. Moreover, the bristle 22 may have a length between 12 mm and 20 mm. The bristle 22 engages the user's teeth when the handle 12 is positioned proximate the user's mouth.

The bristle 22 is one of a plurality of the bristles 30. Continuing, the plurality of bristles 30 is arranged in a plurality of columns 32 and rows 34. The plurality of columns 32 and rows 34 of the plurality of bristles 30 completely covers the top side 24 of the bristle portion 18 of the handle 12. Finally, each of the plurality of bristles 30 may be comprised of a resiliently bendable material.

A processor 36 is coupled to the handle 12. The processor 36 may be an electronic processor of any conventional design. A light emitter 38 is coupled to a bottom side 40 of the bristle portion 18 of the handle 12. The light emitter 38 is electrically coupled to the processor 36. Finally, the light emitter 38 may be an LED of any conventional design.

The light emitter 38 is one of a plurality of the light emitters 42. Moreover, the plurality of light emitters 42 is arranged in a plurality of columns 44 and rows 46. The plurality of columns 44 and rows 46 of the plurality of light emitters 42 are centrally positioned on the bottom side 40 of the bristle portion 18 of the handle 12. Additionally, the plurality of light emitters 42 each is sequentially illuminated by the processor 36 such that the maximum duration of time is communicated when all of the plurality of light emitters 42 is illuminated. Finally, the maximum duration of time may be a duration between 110 seconds and 130 seconds.

An actuator 48 is movably coupled to a top side 50 of the gripping portion 20 of the handle 12. The actuator 48 is positioned proximate the first end 14 of the handle 12. Continuing, the actuator 48 is electrically coupled to the processor 36. The actuator 48 is selectively positionable between an on position and an off position. Finally, the actuator 48 selectively actuates the processor 36.

A power supply 52 is coupled to the gripping portion 20 of the handle 12. The power supply 52 is electrically coupled to the processor 36. Moreover, the power supply 52 comprises at least one battery 54. The power supply 52 is positioned beneath a battery cover 56. Finally, the battery cover 56 is positioned on a bottom side 58 of the gripping portion 20 of the handle 12 proximate the first end 14 of the handle 12.

In use, the actuator 48 is positioned in the on position when the user begins to brush the user's teeth. Continuing, the user continues to brush the user's teeth until all of the plurality of light emitters 42 is illuminated. The plurality of light emitters 42 ensures the user brushes the user's teeth for the minimum amount of time. Additionally, the plurality of light emitters 42 ensures the user does not brush the user's teeth beyond the maximum duration of time.

With respect to the above description, it is to be realized that the optimum dimensional relationship for the various components of the assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An oral hygiene assembly for indicating a maximum duration of time to employ oral hygiene, said assembly comprising:

a handle configured to be gripped by a user wherein said handle is positionable proximate the user's mouth;

a bristle coupled to said handle wherein said bristle engages the user's teeth when said handle is positioned proximate the user's mouth;

a processor coupled to said handle;

a light emitter coupled to said handle, said light emitter being operationally coupled to said processor, said light emitter selectively emitting light wherein said light emitter is configured to communicate the maximum duration of time; and an actuator coupled to said handle, said actuator being operationally coupled top said processor wherein said actuator selectively actuates said processor;

wherein said handle being elongated along a longitudinal axis extending through a first end and a second end of said handle;

wherein said handle having a width being greater than a height of said handle wherein said handle has a rectangular parallelepiped shape;

wherein a bristle portion of said handle having a width being greater than a gripping portion of said handle;

wherein said bristle portion of said handle having a length being less than a length of said gripping portion of said handle;

wherein said light emitter being one of a plurality of light emitters being arranged in a plurality of columns and rows; wherein said plurality of columns and rows of said plurality of light emitters are centrally positioned on a bottom side of a bristle portion of said handle;

wherein said plurality of light emitters each being sequentially illuminated by said processor.

2. The assembly according to claim 1 wherein said bristle being coupled to and extending away from a top side of a bristle portion of said handle.

3. The assembly according to claim 1 wherein said bristle being one of a plurality of said bristles being arranged in a plurality of columns and rows of said plurality of bristles wherein said plurality of columns and rows of said plurality of bristles completely covers a top side of a bristle portion of said handle.

4. The assembly according to claim 1 wherein said light emitter being coupled to a bottom side of a bristle portion of said handle.

5. The assembly according to claim 1 wherein said light emitter being electrically coupled to said processor.

6. The assembly according to claim 1 wherein said actuator being movably coupled to a top side of a gripping portion of said handle such that said actuator is positioned proximate a first end of said handle.

7. The assembly according to claim 1 wherein said actuator being electrically coupled to said processor.

8. The assembly according to claim 1 wherein a power supply coupled to a gripping portion of said handle.

9. The assembly according to claim 8 wherein said power supply being electrically coupled to said processor.

10. The assembly according to claim 9 wherein said power supply comprising at least one battery.

11. An oral hygiene assembly for indicating a maximum duration of time to employ oral hygiene, said assembly comprising:

a handle configured to be gripped by a user wherein said handle is positionable within the user's mouth;

a bristle coupled to said handle wherein said bristle engages the user's teeth when said handle is positioned proximate the user's mouth;

a processor coupled to said handle;

a light emitter coupled to said handle, said light emitter being operationally coupled to said processor, said light emitter selectively emitting light wherein said light emitter is configured to communicate the maximum duration of time; and an actuator coupled to said handle, said actuator being operationally coupled top said processor wherein said actuator selectively actuates said processor;

wherein said handle being elongated along a longitudinal axis extending through a first end and a second end of said handle; said handle having a width being greater than a height of said handle wherein said handle has a rectangular parallelepiped shape; a bristle portion of said handle having a width being greater than a gripping portion of said handle; said bristle portion of said handle having a length being less than a length of said gripping portion of said handle;

wherein said light emitter being coupled to a bottom side of said bristle portion of said handle; said light emitter being electrically coupled to said processor; said light emitter being one of a plurality of light emitters being arranged in a plurality of columns and rows; wherein said plurality of columns and rows of said plurality of light emitters are centrally positioned on said bottom side of said bristle portion of said handle; said plurality of light emitters each being sequentially illuminated by said processor.

12. The assembly according to claim 11 wherein said bristle being coupled to and extending away from a top side of a bristle portion of said handle; said bristle being one of a plurality of said bristles being arranged in a plurality of columns and rows of said plurality of bristles wherein said plurality of columns and rows of said plurality of bristles completely covers a top side of a bristle portion of said handle.

13. The assembly according to claim 11 wherein said actuator being movably coupled to a top side of a gripping portion of said handle such that said actuator is positioned proximate a first end of said handle; said actuator being electrically coupled to said processor; a power supply coupled to a gripping portion of said handle; said power supply being electrically coupled to said processor; said power supply comprising at least one battery.

* * * * *